US007448506B2

(12) United States Patent
Berti

(10) Patent No.: US 7,448,506 B2
(45) Date of Patent: Nov. 11, 2008

(54) ASSEMBLEABLE KNIFE BLOCK COMPOSED OF INDIVIDUAL AUTONOMOUS UNITS

(75) Inventor: Andrea Berti, Scarperia (IT)

(73) Assignee: Coltellerie Berti S.p.A., Scarperia (Firenze) (IT)

( * ) Notice: Subject to any disclaimer, the term of this patent is extended or adjusted under 35 U.S.C. 154(b) by 0 days.

(21) Appl. No.: 11/217,427

(22) Filed: Sep. 2, 2005

(65) Prior Publication Data

US 2006/0049123 A1 Mar. 9, 2006

(30) Foreign Application Priority Data

Sep. 2, 2004 (IT) ..... MI20040407 U

(51) Int. Cl.
*A47F 7/00* (2006.01)

(52) U.S. Cl. ..... 211/70.7; 248/37.7; 206/553

(58) Field of Classification Search ..... 211/70.7, 211/70.6, 70.8; 248/37.3, 232; 206/553, 206/350, 315.11; D7/637; 224/922, 232
See application file for complete search history.

(56) References Cited

U.S. PATENT DOCUMENTS 3,184,882 A * 5/1965 Vega ..... 446/92
4,183,439 A * 1/1980 Bell ..... 211/70.7
4,537,315 A * 8/1985 Griffin ..... 211/70.6
D300,497 S * 4/1989 Goebel et al. ..... D7/637
4,970,006 A * 11/1990 Martinez ..... 248/37.3
D400,057 S * 10/1998 Bounds et al. ..... D7/637
5,850,784 A * 12/1998 Conner ..... 99/485
D405,656 S * 2/1999 Davis et al. ..... D7/637
6,427,340 B1 * 8/2002 Cohen ..... 30/298.4
D495,215 S * 8/2004 Massey, Jr. ..... D7/637
2002/0175131 A1 * 11/2002 Johnson ..... 211/70.7
2005/0258115 A1 * 11/2005 Smith et al. ..... 211/70.7

FOREIGN PATENT DOCUMENTS

DE 298 19 303 U 1 3/1999
DE 200 17 016 U 1 2/2001
DE 200 19 905 U1 * 10/2001
DE 20 2004 002 654 U1 6/2004
GB 2 383 740 7/2003

* cited by examiner

*Primary Examiner*—Kambiz Abdi
*Assistant Examiner*—Lindsay M. Maguire
(74) *Attorney, Agent, or Firm*—Young & Thompson

(57) ABSTRACT

An attachable knife block of a type having a storage body, in which various blade housings are located. The block is characterised by the fact that it is made up of a series of autonomous attachable and detachable units which may be attached/detached each other through connecting elements, each of the aforementioned autonomous units including a single blade housing in which just one knife can be housed.

21 Claims, 3 Drawing Sheets

ASSEMBLEABLE KNIFE BLOCK COMPOSED OF INDIVIDUAL AUTONOMOUS UNITS

BACKGROUND OF THE INVENTION

The present invention relates to a modular knife block.

As is often observed, knives, in particular kitchen knives are kept and maintained within easy reach and access of a work surface or area. The knives and their blades are usually displayed in such a way so as to avoid any possible dangerous/accidental contact by those working within reach.

The use of the so called knife block is common practice; whether it is for its practical or aesthetic value the knife block is usually a mono-block made out of a material specially selected for its intended use. Woods and various plastic based materials are typical—the shape of the block is adapt for a correct and stable positioning on the work surface. The block is usually heavy in weight and has a number of holes or slits into which the various shaped knives can be inserted. Once inserted into the housing slits the knife blades are completely hidden inside the block, while the handle remains on the outside.

The knife block presents itself as a useful apparatus for the correct display of a set of knives while at the same time it both protects the blades and makes the knife handle easily accessible for the user.

However, the knife block has been widely spread on the market mainly for a specific commercial gain and purpose: that is to arrange a full set of knives in a single package to be purchased. In this way, the user/consumer ends up buying a full set of knives, within the same attractive block, of which a certain number he/she will find very little use or actually none at all.

Given this historical/commercial motivation a knife block containing less than three or five knives has never been proposed to the market: in fact an inferior number is not commercially viable and it is rather more convenient to offer the single knife in a kind of "disposable" holder/sheath, which knife may be located in the most convenient place for the user.

A significant drawback then of the traditional knife block would appear to be its predetermined size and its inflexibility to be modified as required. Meaning in the first place the user is forced to buy the set of knives according to the form, size, practicality and more often than not the aesthetic value of the knife block itself. Furthermore the mono-block by definition can not be modified, even though in time certain knives may be broken or remain unused which, in turn means the unused blade housings in the mono-block become excess.

Furthermore due to fact that the single blade housings are not easily accessible during manufacturing—that is if the mono-block were not to be divided into units and assembled later on (which would prove too costly)—it is common practice to cut them all according to a standard form (typically rectangular or parallelepipedal) which can be done easily using traditional cutting tools (circular saws or cutters). This means however that traditional blocks made according to the aforementioned technical note, cannot cater for blades of forms different to the standard.

The way in which the blade housings are cut regularly to size means that very often dirt and organic particles accumulate inside the housing—ferment and become mouldy emitting unpleasant smells, eventually becoming harmful to the hygiene state of the knives themselves. And given the fact that all the housings are cut to the same height/profundity the risk of residual accumulation in the housings where shorter knives are kept is higher, since the shorter blades remain only in the upper part of the housing. The blade housings are not easily accessed by the user for the required proper cleaning—eventually the block is a health hazard and has to be discarded.

With the aforementioned requirements in mind, knife blocks made up of two or three portions have been developed, portions which can be mounted into a mono-block and subsequently dismantled for cleaning etc. The separation lines of the various portions are designed in such a way as to expose, upon dismantling the block, the inner parts of the knife housings—at which point the user may clean the housings properly. Patent number WO 03/099081, for example, discloses this type of solution.

The above solution resolves the problem of hygiene of the blade housings however the other problems still remain. In addition there are also other problems linked to the actual construction thereof. In the first place the very fact that the separation lines for dismantling necessarily affect the knife housing, in order to avoid the formation of ugly openings and gaps in the block through use a tight, resistant locking means is necessary between the various portions. Locking means which in time through repeated mounting and dismantling will not wear and tear. Of course such a resistant means would increase the final cost of the knife block considerably. Secondly, especially in the case where the block is made of wood and since use of adhesives is not compatible with dismantling requirements, undesirable cracks do actually form along the separation lines of the blade housing where alimentary residues easily accumulate and which in turn can lead to the insertion of the knife blade into the block.

A further drawback regarding the aforementioned knife block lies with the fact that the blades tend to escape from their housing much more easily within this type of block due to the excess 'play' in the blade housing and very often, an improper inclination of the block while moving it, is sufficient enough for the knives to dangerously slide out of place, causing harm as one can quite imagine.

SUMMARY OF THE INVENTION

The Applicant has therefore set the object of supplying a new knife block which takes into account the various drawbacks listed above. Aiming to overcome the prejudice as stated previously, regarding the technical/commercial value of the knife block—existent within the sector for years—the Applicant has aimed to put to test an innovative form and consequently innovative use of the traditional knife block, which render it particularly efficient and useful with respect to a criteria other than that already noted.

The object outlined above has been achieved, according to the invention, through an attachable knife block.

According to the invention, it is provided a knife block, of a type having a storage body, in which various blade housings are defined, wherein the block is made up of a series of autonomous attachable and detachable units—attached to each other by connecting means, each of the aforementioned autonomous units having a single blade housing to house just one knife.

According to a further aspect, connecting means are magnets of opposing polarity embedded in the walls of each modular unit, said magnets also having the added function of slightly holding the knife blade in place within their respective housing.

BRIEF DESCRIPTION OF THE DRAWINGS

Further advantages and characteristics of the invention are better highlighted in the following detailed description, given by way of example and illustrated in the drawings attached.

PREFERRED EMBODIMENTS OF THE INVENTION

Figure 1:
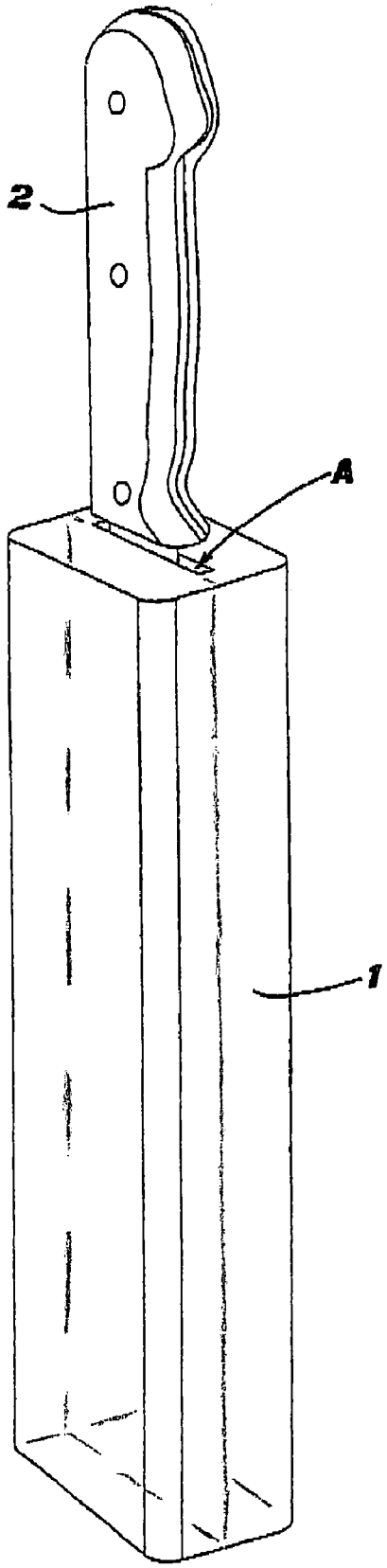
FIG. 1 is a perspective view of a unit for the assembleable knife block of the invention.
Figure 3:
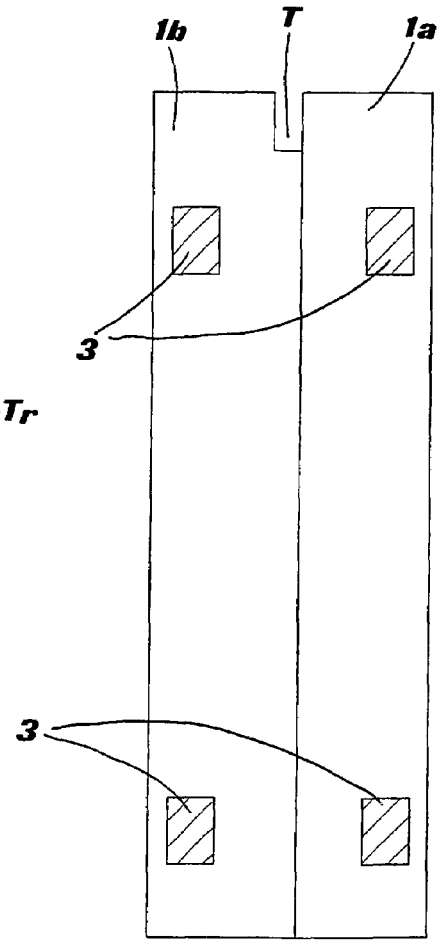
FIG. 3 is a section view of unit illustrated in FIG. 1 along the line III-III of FIG. 2.

The assembleable knife block according to the invention is made up of a certain number of elementary autonomous modular units 1 (FIG. 1)—wherein one single knife 2 is located—the various units being apt to be connected in a releasable manner by connecting means 3 (FIG. 3).

In the following, an elementary autonomous modular unit is intended as a single body having a definite, self-sustaining shape and fitted with an internal housing T for a knife blade, said unit appearing at sight aesthetically complete and autonomous.

Figure 2:
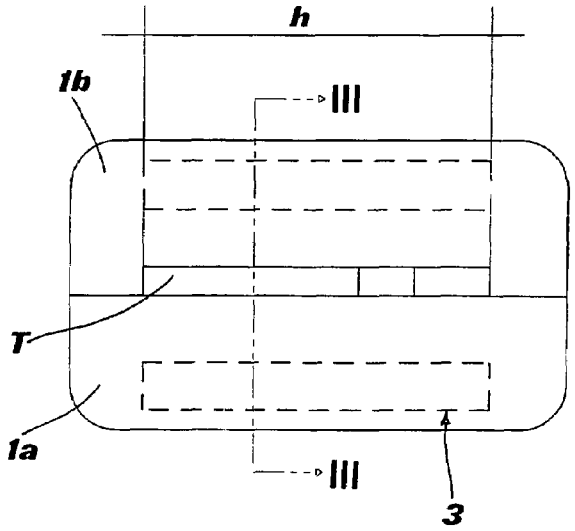
FIG. 2 is a top plan view of unit illustrated in FIG. 1.

As seen in FIG. 2, each modular unit is advantageously built up of two opposed complimentary semi half parts 1*a* and 1*b*, made up of homogeneous and inherent material, for example wood, extending longitudinally, then in turn fixed together by adhesives or some other kind of permanent fastening.

Preferably a housing T for the knife blade 2 should be preferably cut wholly in to just one of the halves, for example in the left half 1*b*.

Thanks to the fact that each modular unit is made up of two semi half parts 1*a* and 1*b* and is intended to house just one knife, the tools required to cut the housing T on the inner face of the semi half part 1*b* (seen in FIG. 4) can easily access that face and cut whatever blade shape/form desired for the housing T with a simple milling cutter.

In other words, in each modular unit the housing T can be 'made to measure' for any knife destined to be housed in the aforementioned modular unit. And moreover the depth of the housing T can be varied according to requirement—modifying accordingly the height of modular unit 1.

Figure 4:
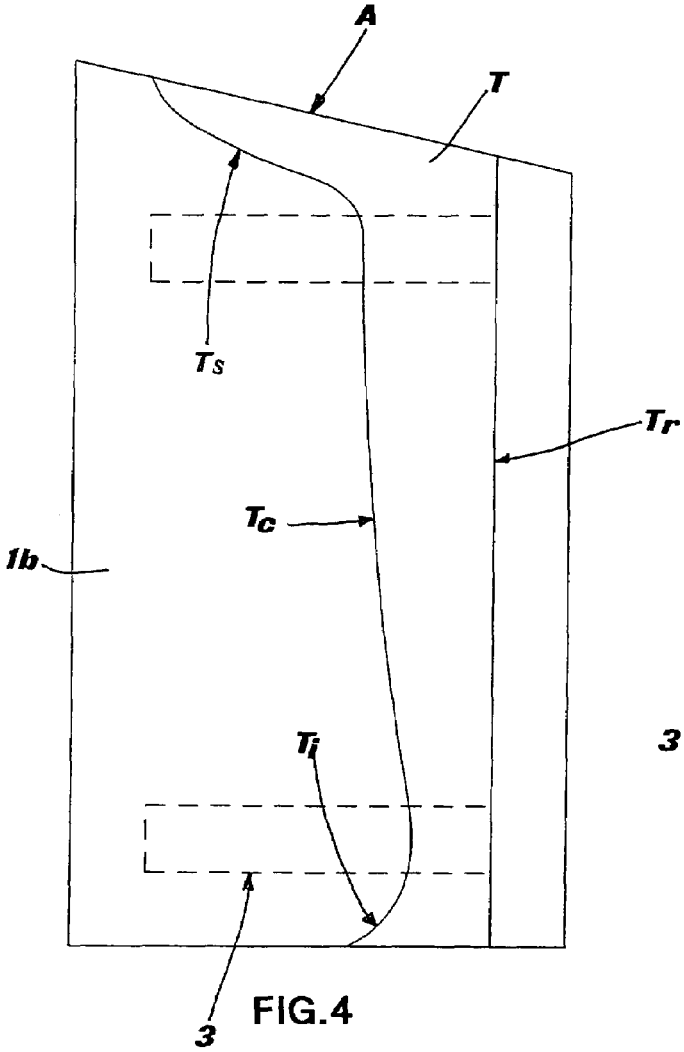
FIG. 4 is a side elevation view of one of semi half portions of modular unit, where blade housing resides.

According to an aspect of the invention, by allowing for the cutting of the housing T to any required blade shape and profile thereby gives the modular knife block an added value. The preferred shape of the housing T as seen in FIG. 4, requires that said blade housing be outlined on one side by a straight line Tr, against which the back edge of the knife blade rests. On the opposite side the outline is curved, and this can be subdivided into an upper section Ts, a central section Tc, and a lower section Ti.

The upper section Ts of the curved line is shaped such as to determine the height of the inlet opening A of the housing T, which also extends across the whole of the length of the unit 1, and consequently has a uniform height h—independently of the dimensions of the knife to be housed therein. From the opening A the line Ts follows a slightly inclined profile towards to central section Tc. This profile of the first inserting portion of the housing both facilitates the insertion of knives—thanks to the fact that all the openings A of the single associated units have the same width—and as a safe guide for the blade as it is being placed in the housing, independent of its insertion point in the opening A, thanks to the fact that the point of the blade slides naturally to place along the inclined profile Ts until it enters the deep portion of the housing T.

In addition to the above practical advantages, there is also an added aesthetic value: even though the single modular units are cut accordingly to house knives of varying dimensions—it is noted that in each case the top surface, where opening A is made, is perfectly identical.

The line Tc which traces the central section of the housing T gradually tapers inward so as to trace the outline of the blade of the knife designated to be kept in the housing. The line of the Tc section is slightly curved so that the blade sharp edge only rests at two points—thereby the ensuring a correct and stable positioning of the knife which in turn maintains the sharp edge of the blade that remains not in contact with the block itself for the most part of its full length. It is important to note the housing T is designed as such that the whole of the blade back edge of the inserted knife is snugly positioned along the Tr section while the cutting edge of the blade lightly touches the only two points along the Tc section—guaranteeing a perfect automatic vertical alignment of the knife inside each unit.

The final section of the housing T is outlined by the line Ti which has a rounded form curving away from the Tr line and therefore does not come into contact with the blade tip. The space left beneath the knife while held in place, serves to catch any alimentary residues which may been on the knife. The sections Ts, Tc and Ti along the curved formation of the housing T are joined together with smooth continuous curves with no rough edges meaning that the cleaning of the inside of the housing, with a water jet or such like, is carried out easily, rapidly and efficiently.

In order to assemble various modular units 1 together and thereby form a complex knife block, connecting means are needed to hold firmly together two adjacent units. The modular knife block is formed of a line of module units of the same and different heights containing knives chosen personally and specifically by the user. The connecting means may be of any known type, preferably quick action, slack free and not requiring the use of specific tools to be operated, such as: magnetic connectors, bayonet or swallow tailed longitudinal joints, pin/seat connections, quick-fit threaded couplings, and the like.

A presently preferred connection means is by using magnetic elements. Magnetic elements maybe inserted into the block walls thereby remaining hidden from view and also have the added advantage of not requiring any type of apparatus or tools for assembly. By simply placing the units near each other the user may group the units together as and when required. The same again for dismantling or rearranging of the units at a later date, the user simply pulls the units apart—on the contrary to various other assembly systems which very often present problems of blocking or ageing of joints etc, especially where wooden knife blocks are used in damp/wet environment.

In the embodiment illustrated in FIG. 3 and FIG. 4 the magnetic elements are bars 3, inserted just below the external surface of the semi half parts 1*a* and 1*b*, parallel to the wider/longer side of the unit 1. It is preferable that in each unit 1 there be four magnetic bars 3, placed horizontally in the upper and lower portions of the unit in order to guarantee a more stable connection on both sides. Naturally the upper bars 3 of the modular units 1, are positioned at such a height as to permit assembly with smaller units.

Figure 5:
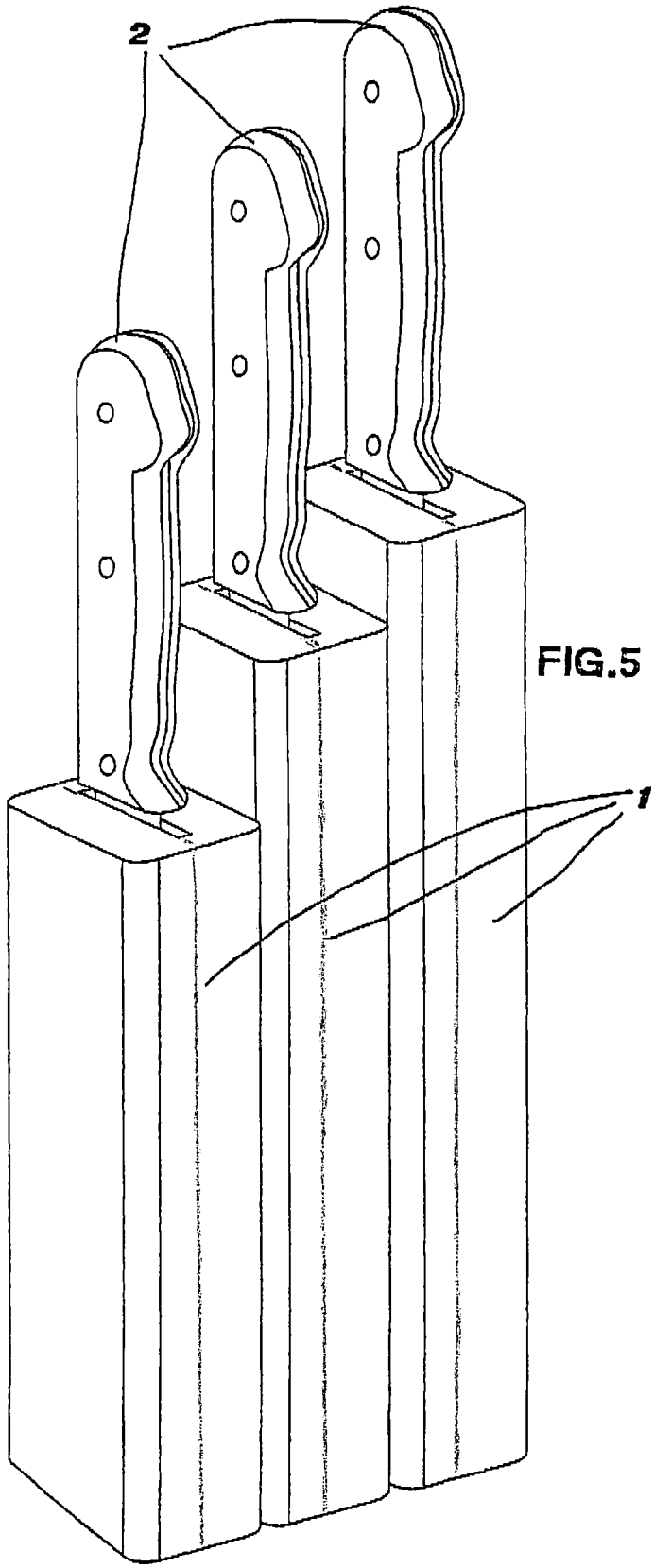
FIG. 5 is a view similar to FIG. 1 representing a three knife block according to the invention.

The magnetic polarity of the bars 3 inserted into the lateral parts of each unit, left and right are opposite in order that the various modular units may be connected side by side (FIG. 5) using magnetic attraction. Even the polarity of the bars placed on the same side of the units should be preferably opposites, for example N for the upper bar and S for the lower bar. In this case, on the opposite side of the unit the magnetic bars have polarity correspondingly reversed, i.e. S for the upper bar and N for the lower bar. This arrangement also offers an added advantage—i.e. there can be only one correct assembly position of the units, which can neither be rotated 180° or unturned 180°.

In addition to maintaining a stable and secure connection between modular units of the block, the magnetic bars 3 are also able to hold the metal knife blades with sufficient force to prevent any unwanted and accidental falling out of the blade housing—caused accidentally in case of dropping or knocking from a work surface.

As appearing evident from the above description, the assembleable knife block of the invention fulfils completely the objectives outlined in addition to offering numerous other advantages. The fact that it is made up of single autonomous elementary units means that it does not present those problems as reported previously that the traditional knife block with various blade housings does.

The assembling of the single units in the modular knife block can, more importantly, be decided by the user according to personal requirements, necessity and eventual space available around the work area. The user may also put together a pleasing aesthetic effect by taking advantage of the different unit heights while putting together the knife block, an example of which can be seen in FIG. 5.

The knife block can be increased and decreased rapidly and easily according to necessity i.e. according to those knives in constant actual use. Furthermore the user is free to buy only those blades and consequently modular units actually required inserting them into a customized modular knife block, which can be updated and modified at any one given time by the user.

However, it is understood that the invention is not limited to the specific embodiments illustrated above, which merely represent non-limiting examples of the scope of the invention, but that a number of variants are possible, all within the reach of a skilled person in the field, without departing from the scope of the invention.

For example, even though the modular knife block described herewith is made up of a lateral placement of single autonomous elementary units, "side by side", it is also possible to provide for units equipped with connecting means also on the shorter/narrower sides.

Furthermore, the parallelepipedal shape of the units should not be intended as limiting the scope of the invention, since various forms of the units are on hand to any expert in the field and by taking advantage of the principles herewith expressed the results could be of the same technical merits with rather different aesthetic appearances.

The invention claimed is:

1. A knife block having a storage body, in which storage body a plurality of blade housings are defined, wherein, said storage body is made up of a series of autonomous modular units; and a set of magnetic couplings are inserted just below an external surface of each autonomous modular unit and hidden from external view, wherein, each of said autonomous modular units is magnetically attachable and detachable with said another autonomous modular unit through the corresponding ones of said magnetic couplings without the use of tools, and each of said autonomous modular units comprises a single blade housing for a knife blade and each blade housing is of a size different from the other blade housings, said magnetic couplings are positioned to magnetically act on a knife blade inserted within the blade housing to magnetically hold the knife blade within the blade housing.

2. The knife block as in claim 1, further comprising a knife housed in each blade housing, and wherein each modular unit is made to fit, in terms of height and a shape of the blade housing, the knife housed in the blade housing.

3. The knife block as in claim 1, wherein each modular unit comprises two complementary semi half parts extending longitudinally.

4. The knife block as in claim 3, wherein said blade housing is located in at least one of the semi half parts of the modular unit.

5. The knife block as in claim 3, wherein said blade housing is entirely located in just one of the semi half parts of the modular unit.

6. The knife block as in claim 3, wherein said two semi half parts are fixed together and not separable from each other.

7. The knife block as in claim 1, wherein said magnetic couplings comprise magnetic bars inserted and positioned in opposing lateral parts of the modular units.

8. The knife block as in claim 7, wherein said magnetic bars are arranged horizontally, at least one for each side, along the two opposite longer sides of the unit.

9. The knife block as in claim 7, wherein said magnetic bars located at the same height have opposite polarity on the opposite sides of the modular unit.

10. The knife block as in claim 7, wherein said magnetic bars include two magnetic bars for each side of the unit, positioned in the upper and lower areas of the unit.

11. The knife block as in claim 1, wherein said blade housing has a smooth continuous curved line, free of rough edges, for the insertion and subsequent support of a blade edge, comprising an upper section which joins an entry opening of the housing to a central portion of the housing to contain the knife blade, a central section along which the sharp edge of the blade is to rest and a final draining lower section.

12. The knife block as in claim 11, wherein the profile of the curved line of the central section of the blade housing follows a general curved profile.

13. Modular unit for a knife block as in claim 1, characterised in that it is mainly made of wood or wooden materials.

14. A knife block, comprising:

a series of magnetically-connected autonomous modular units, each modular unit being a size different from the remaining modular units;

a single blade housing with each modular unit, each blade housing being of a size different from the remaining blade housing;

a set of hidden magnetic couplings inserted below an external surface of each modular unit and hidden from external view, wherein, each of said modular units is magnetically attachable and detachable with another of said modular units through magnetic coupling of corresponding ones of said magnetic couplings, and said set of magnetic couplings are positioned to also magnetically act on a knife blade inserted within the blade housing to magnetically hold the knife blade within the blade housing.

15. The knife block as in claim 14, wherein each modular unit comprises two complementary semi half parts extending longitudinally.

16. The knife block as in claim 15, wherein said blade housing is located in at least one of the semi half parts of the modular unit.

17. The knife block as in claim 15, wherein said blade housing is entirely located in just one of the semi half parts of the modular unit.

18. The knife block as in claim 14, wherein said magnetic couplings comprise magnetic bars inserted and positioned in opposing lateral parts of the modular units.

19. The knife block as in claim 18, wherein said magnetic bars are arranged horizontally, at least one for each side, along the two opposite longer sides of the unit.

20. The knife block as in claim 19, wherein said magnetic bars located at the same height have opposite polarity on the opposite sides of the modular unit.

21. The knife block as in claim 19, wherein said magnetic bars include two magnetic bars for each side of the unit, positioned in the upper and lower areas of the unit.

* * * * *